US008994607B1

(12) United States Patent
Lin et al.

(10) Patent No.: US 8,994,607 B1
(45) Date of Patent: Mar. 31, 2015

(54) SPIRAL/CONFORMAL ANTENNA USING NOISE SUPPRESSION/MAGNETIC SHEET ABOVE GROUND PLANE

(75) Inventors: Leon Y. Lin, San Diego, CA (US); Thomas O. Jones, III, San Diego, CA (US); David W. Brock, San Diego, CA (US); Peter S. Berens, San Diego, CA (US); Hale B. Simonds, Santee, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 878 days.

(21) Appl. No.: 13/104,740

(22) Filed: May 10, 2011

(51) Int. Cl.
*H01Q 7/00* (2006.01)
*H01Q 9/27* (2006.01)
*H01Q 1/38* (2006.01)

(52) U.S. Cl.
CPC ... *H01Q 9/27* (2013.01); *H01Q 1/38* (2013.01)
USPC ..... 343/868; 343/895

(58) Field of Classification Search
CPC ..... H01Q 1/286; H01Q 1/28; H01Q 7/00; H01Q 9/27; H01Q 1/38; H01Q 1/36
USPC ..... 343/705, 708, 868, 895
See application file for complete search history.

(56) References Cited

U.S. PATENT DOCUMENTS 5,313,216 A * 5/1994 Wang et al. ..... 343/700 MS
5,353,040 A * 10/1994 Yamada et al. ..... 343/895
5,453,752 A * 9/1995 Wang et al. ..... 343/700 MS
5,508,710 A * 4/1996 Wang et al. ..... 343/726
5,589,842 A * 12/1996 Wang et al. ..... 343/787
6,011,522 A * 1/2000 VanHoozen et al. ..... 343/792.5
6,121,936 A * 9/2000 Hemming et al. ..... 343/769
6,160,522 A * 12/2000 Sanford ..... 343/769
6,198,445 B1 * 3/2001 Alt et al. ..... 343/705
6,285,337 B1 * 9/2001 West et al. ..... 343/853
6,822,616 B2 * 11/2004 Durham et al. ..... 343/795
6,906,674 B2 * 6/2005 McKinzie et al. ..... 343/767
7,084,827 B1 * 8/2006 Strange et al. ..... 343/795
7,126,548 B2 * 10/2006 Yano et al. ..... 343/702
7,405,709 B2 * 7/2008 Takahashi et al. ..... 343/788
7,629,928 B2 * 12/2009 Fabrega-Sanchez et al. ..... 343/700 MS
8,261,997 B2 * 9/2012 Gebhart ..... 235/492
8,368,615 B1 * 2/2013 David et al. ..... 343/909
8,497,808 B2 * 7/2013 Wang ..... 343/737
8,665,069 B2 * 3/2014 Weitzhandler et al. ..... 340/10.1
2003/0076274 A1 * 4/2003 Phelan et al. ..... 343/895
2006/0176232 A1 * 8/2006 Strange et al. ..... 343/810
2008/0246680 A1 * 10/2008 Rawnick et al. ..... 343/795
2010/0007572 A1 * 1/2010 Jones et al. ..... 343/798

OTHER PUBLICATIONS

Saville, Paul, Review of Radar Absorbing Materials, Jan. 2005, pp. 15-17 & 35-41.*

* cited by examiner

*Primary Examiner* — Paultep Savusdiphol
(74) *Attorney, Agent, or Firm* — SPAWAR Systems Center Pacific; Kyle Eppele; Peter A. Lipovsky

(57) ABSTRACT

A spiral antenna apparatus utilizes a noise suppression sheet that is interposed between the spiral antenna element and its ground plane. The noise suppression sheet permits an extremely compact spiral antenna apparatus while lessening antenna performance degradation.

2 Claims, 3 Drawing Sheets

SPIRAL/CONFORMAL ANTENNA USING NOISE SUPPRESSION/MAGNETIC SHEET ABOVE GROUND PLANE

FEDERALLY-SPONSORED RESEARCH AND DEVELOPMENT

This invention is assigned to the United States Government. Licensing inquiries may be directed to Office of Research and Technical Applications, Space and Naval Warfare Systems Center, Pacific, Code 72120, San Diego, Calif., 92152; telephone 619-553-2778; email: T2@spawar.navy.mil. Please reference Navy Case No. 100726.

BACKGROUND

Spiral antennas often lend themselves to conformal applications however minimizing the profile of these antennas can lead to negative antenna performance. It is desirable to be able to lessen the profile of a spiral antenna without compromising its performance.

SUMMARY

A spiral antenna apparatus utilizes a noise suppression sheet that is interposed between the spiral antenna element and its ground plane. The noise suppression sheet permits an extremely compact spiral antenna apparatus while lessening antenna performance degradation.

DETAILED DESCRIPTION

Spiral antenna engineers know that to achieve a unidirectional beam from a spiral antenna, a conducting cavity "behind" the spiral may be used. It is also known that as the distance between the spiral antenna element and the cavity is decreased below a quarter of the operating wavelength of the antenna, the performance characteristics of the antenna will substantially fall off. Under those conditions, circular polarization and gain can considerably suffer. It many cases, a "shallow" cavity-based spiral antenna apparatus is desirable as the apparatus can be made quite flexible and therefore be applied (adhered) directly to the surface of a vehicle such as an aircraft or marine vessel. Shallow cavity-based spiral antennas require however that measures be taken to enhance their operating characteristics.

The conformable antenna apparatus described herein utilizes a disc-shaped noise absorbing sheet that is interposed between a spiral antenna element and the ground plane of the antenna conducting cavity. The noise absorbing sheet may be designed to extend beyond the diameter of the spiral antenna element and can be placed either directly on the ground plane or in an intermediate position between the spiral antenna element and the ground plane. In either case, a spacer such as foam can be employed to position the noise suppressant sheet/spiral antenna element from the ground plane of the antenna apparatus.

Figure 1:
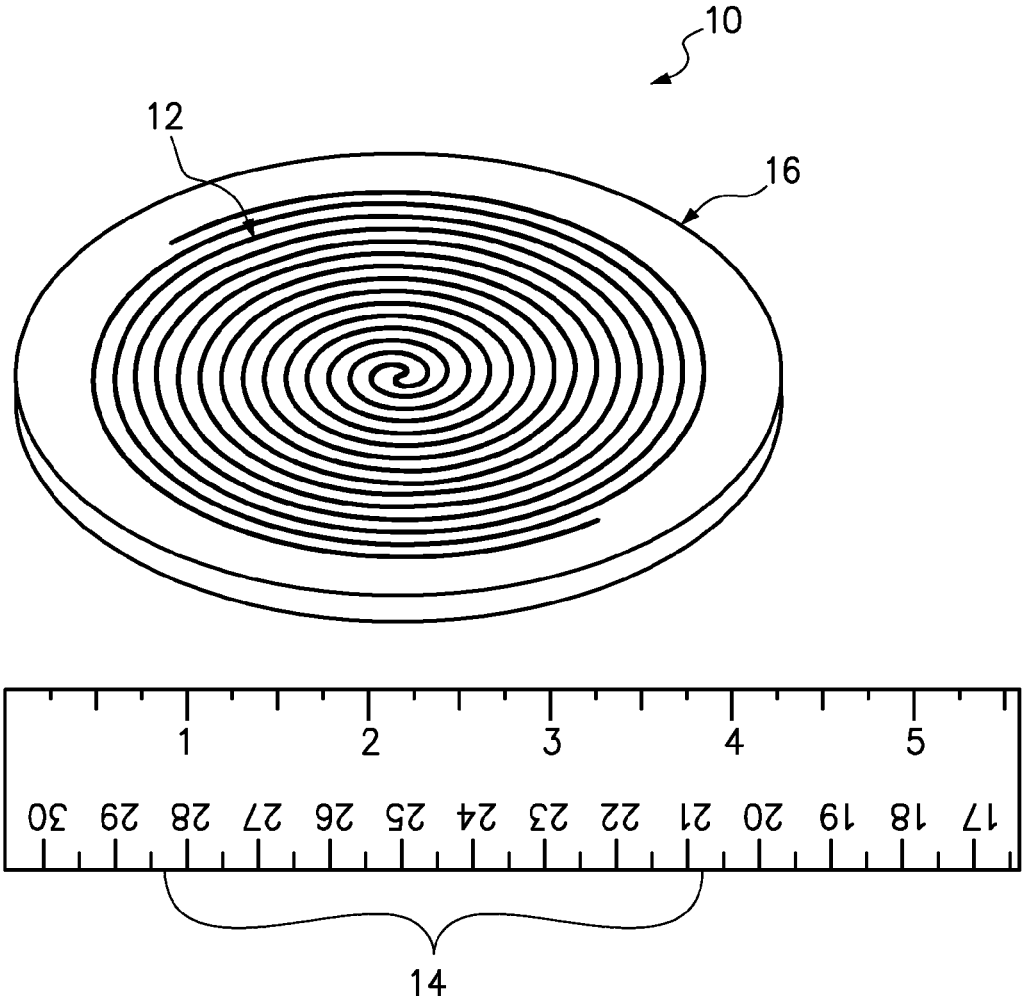
FIG. 1 is an image of an example operational embodiment of a conformal antenna apparatus according to the description herein.

Referring now to FIG. 1, there is shown a conformable antenna apparatus 10 having a conformable spiral antenna element 12. Antenna element 12 has maximum diameter 14 when antenna element 12 is in a substantially planar configuration. As shown in this example, a disc-shaped noise suppression sheet 16 extends beyond diameter 14 of the antenna. The nature of the noise suppression sheet material and characteristics of usage of the material will be explained following a description of the various embodiments of the invention.

Figure 2:
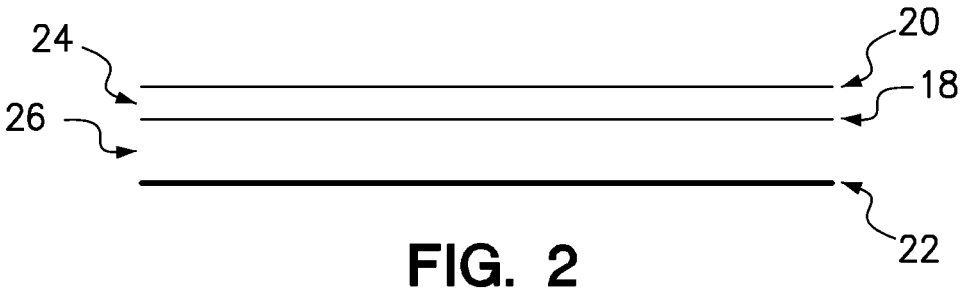
FIG. 2 portrays a side view of one embodiment of a conformal antenna apparatus according to the description herein.

Referring now to FIG. 2, a side view of one embodiment of the conformable antenna apparatus according to the description herein is shown. In this embodiment, it can be seen that a disc-shaped conformable noise suppression sheet material 18 is placed in an intermediate position with respect to conformable spiral antenna element 20 and conformable ground plane 22 of this cavity-based antenna configuration.

A flexible spacer 24 is used to space the noise suppression sheet 18 from the antenna element 20. While a variety of spacer materials may be utilized, foam and particularly white foam lends itself to such an application as the white foam has properties much like that of air.

In this embodiment, an additional flexible foam spacer 26 is placed between conformable noise suppressant sheet 18 and conformable ground plane 22 to position the antenna element and noise suppression sheet at predetermined distance from ground plane 22. In this instance, the distance between antenna element 20 and ground plane 22 makes up the height of this cavity-based antenna apparatus.

Figure 3:
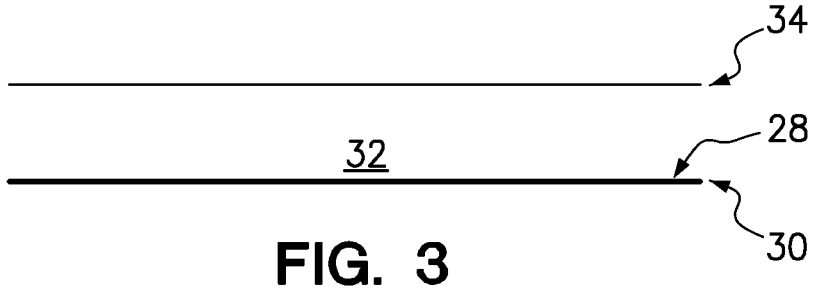
FIG. 3 shows a side view of an additional embodiment of a conformal antenna apparatus according to the description herein.

The embodiment shown in FIG. 3 is one wherein a disc-shaped conformable noise suppressant sheet 28 is adhered directly on (and placed immediately adjacent to) conformable ground plane 30. As with the embodiment shown in FIG. 2, a flexible spacer 32 is used to space antenna element 34 from ground plane 30. Though a variety of spacer techniques may be used, spacer 32 may be a foam and more particularly white foam.

Figure 4:
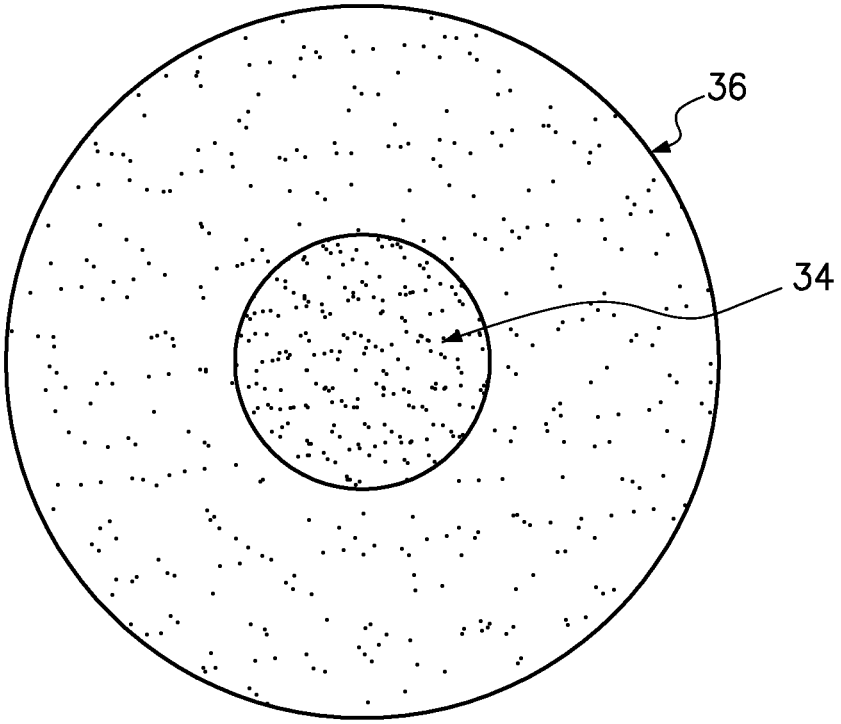
FIG. 4 illustrates a double noise absorber material approach according to the description herein.

In FIG. 4, a double noise suppression material approach is taken wherein a disc-shaped conformal noise suppression sheet 34 is surrounded by a co-planar ring-shaped conformal noise suppressions sheet 36. Each of these sheets has a different magnetic permeability.

The noise suppression sheets used are commercially available and have magnetic permeability (mu) falling in the range of about 40 at 1 MHz to about 100 at 1 MHz. The absorbers used contain Fe and Si, one being of Fe—Si—Cr composition and another of Fe—Si—Al composition.

A test sheet of 0.5 millimeters thickness was used though thinner sheets are available and considered feasible as well. Additionally, one test version utilized a sheet with a hole but this was found to perform not as well as an un-perforated sheet.

The operational model depicted in FIG. 1 operated at 1-18 Giga Hertz and had a total canister height (spiral antenna element to ground plate of 0.25 inches—working out to be about $1/47^{th}$ of wavelength at 1 GHz. As a comparison, a conventional conformal spiral antenna apparatus requires the antenna element to ground plane to be spaced a quarter of wavelength at lowest operating frequency.

A version of the operation model used a double-noise material approach wherein the inner disc-shaped material had a magnetic permeability of 40 at 1 MHz and a surrounding outer co-planar ring-shaped noise suppression sheet having a magnetic permeability of 100 at 1 MHz.

Example materials are available through TDK such as their IRJ04 and IRJ09 flexible electromagnetic shield materials, respectively. Other manufacturers of similar materials are Mast Technologies of 6370 Nancy Ridge Drive, Suite 103, San Diego, Calif. 92121 U.S.A. identified as their MR51-0004-00 and MR51-0002-00 materials and Leader Tech of 14100 McCormack Drive, Tampa, Fla. 33626 U.S.A. identified as their EA 3200 material.

It was found that extending the absorber material beyond the maximum diameter of the spiral antenna element (when planar) was beneficial when using an 18 inch diameter spiral. Testing was additionally done of a six inch diameter spiral with absorbers of 7.5 inches diameter and 8 inches diameter (a twenty-five percent to 30 percent increase in diameter beyond that of the spiral antenna element).

It is to be understood that many additional changes in the details, materials, steps and arrangement of parts, which have been herein described and illustrated to explain the nature of the invention by way of example, may be made by those skilled in the art within the principle and scope of the invention as expressed in the appended claims.

What is claimed is:

1. A conformable wide-band antenna apparatus comprising:

a conformable spiral antenna element;

a conformal ground plane; and a solid disc-shaped conformal noise suppression sheet interposed between said conformal spiral antenna element and said conformal ground plane, said conformal noise suppression sheet having a magnetic permeability (mu) in the range of about 40 at 1 MHz to about 100 at 1 MHz, wherein said disc-shaped conformal noise suppression sheet is surrounded by a co-planar ring-shaped conformal noise suppression sheet having a magnetic permeability (mu) in the range of about 40 at 1 MHz to about 100 at 1 MHz and of a different magnetic permeability than the magnetic permeability of said disc-shaped conformal noise suppression sheet; and wherein said conformable spiral antenna element is spaced from said conformal ground plane by a spacer.

2. A conformable wide-band antenna apparatus comprising:

a conformable spiral antenna element, said conformable spiral element having a maximum diameter when in a substantially planar configuration;

a conformal ground plane, said conformal ground plane having a diameter at least equivalent to said maximum diameter of said conformable spiral antenna element; and a solid disc-shaped conformal noise suppression sheet interposed between said conformal spiral antenna element and said conformal ground plane, said conformal noise suppression sheet having a diameter at least equivalent to said diameter of said conformal ground plane and having a magnetic permeability (mu) in the range of about 40 at 1 MHz to about 100 at 1 MHz, wherein said disc-shaped conformal noise suppression sheet is surrounded by a co-planar ring-shaped conformal noise suppressions sheet having a magnetic permeability (mu) in the range of about 40 at 1 MHz to about 100 at 1 MHz and of a different magnetic permeability than the magnetic permeability of said disc-shaped conformal noise suppression sheet; and wherein said conformable spiral antenna element is spaced from said conformal ground plane by a foam spacer.

* * * * *